US011598182B2

(12) United States Patent
Brohi et al.

(10) Patent No.: US 11,598,182 B2
(45) Date of Patent: Mar. 7, 2023

(54) METHODS OF PRODUCING HYDROCARBONS FROM UNCONSOLIDATED SAND FORMATIONS

(71) Applicant: Saudi Arabian Oil Company, Dhahran (SA)

(72) Inventors: Imad Brohi, Dhahran (SA); Adel A. Qahtani, Khobar (SA); Rayan A. Alidi, Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/198,800

(22) Filed: Mar. 11, 2021

(65) Prior Publication Data

US 2022/0290532 A1 Sep. 15, 2022

(51) Int. Cl.
*E21B 43/10* (2006.01)
*E21B 43/08* (2006.01)

(52) U.S. Cl.
CPC ..... *E21B 43/10* (2013.01); *E21B 43/084* (2013.01)

(58) Field of Classification Search
CPC ..... E21B 43/10; E21B 43/084
See application file for complete search history.

(56) References Cited

U.S. PATENT DOCUMENTS 3,228,468 A * 1/1966 Nichols ..... E21B 43/247 166/259
5,289,876 A * 3/1994 Graham ..... E21B 43/025 166/278
5,507,344 A * 4/1996 Young ..... E21B 43/267 166/278
8,490,697 B2 7/2013 Garcia et al.
2003/0075361 A1* 4/2003 Terry ..... E21B 19/086 175/171
2008/0006413 A1* 1/2008 Le Gloahec ..... E21B 43/084 166/227
2009/0095471 A1 4/2009 Guignard et al.
2015/0176378 A1* 6/2015 Ramey, Jr. ..... E21B 41/0035 166/387

(Continued)

OTHER PUBLICATIONS

Dickinson et al., "Horzontal Radial Drilling System", Society of Petroleum Engineers, SPE 13949, Mar. 27-29, 1985.

(Continued)

*Primary Examiner* — Taras P Bemko
(74) *Attorney, Agent, or Firm* — Dinsmore & Shohl LLP

(57) ABSTRACT

A method of drilling an uncompleted lateral wellbore in a subsurface formation includes drilling the uncompleted lateral wellbore with coiled tubing in the subsurface formation. The subsurface formation includes unconsolidated sand and the subsurface formation overlays a water-saturated reservoir. The method may further include introducing particles having an average particle size of from 8 mesh to 140 mesh into the uncompleted lateral wellbore, thereby supporting the uncompleted lateral wellbore and avoiding wellbore collapse and installing a screen in a vertical wellbore fluidly connected to the uncompleted lateral wellbore, wherein the screen has a mesh size of from 325 mesh to 1000 mesh. The subsurface formation may include hydrocarbons and the method may further include producing hydrocarbons from the subsurface formation.

18 Claims, 3 Drawing Sheets

(56) References Cited

U.S. PATENT DOCUMENTS

| | | | | |
|---|---|---|---|---|
| 2016/0369602 | A1* | 12/2016 | Frosell | E21B 33/12 |
| 2019/0316024 | A1* | 10/2019 | Prakash | C09K 8/68 |
| 2020/0117318 | A1* | 4/2020 | Jayabal | G06F 17/15 |

OTHER PUBLICATIONS

Durst, "Multilateral Gravel-Pack Solutions for Single Wellbore Branches", Offshore Technology Conference, OTC-26492-MS, Mar. 22-25, 2016.

Frieman et al., "Use of the Dual-Screen Thru-Tubing Sand Control Method", Society of Petroleum Engineers, SPE 28698, Oct. 10-13, 1994.

Mathisen et al., "Successful Installation of Stand Alone Sand Screen in More than 200 Wells—The Importance of Screen Selection Process and Fluid Qualification", Society of Petroleum Engineers, SPE 107539, May 30-Jun. 1, 2007.

Munro et al., "Stimulating Sand Screen Completions with Coiled Tubing", Society of Petroleum Engineers, SPE 74807, Apr. 9-10, 2002.

Nettleship et al., "Installation of Complex Multilateral Wells with Standalone Sand Screens in the Vincent Field", Society of Petroleum Engineers, Drilling & Completion, pp. 150-164, Jun. 2014.

Song et al., Succeeding with Multilateral Wells in Complex Channel Stands, Society of Petroleum Engineers, SPE 110240, Oct. 30-Nov. 1, 2007.

Van Vliet, et al., "Horzontal Openhole Gravel Packs Boost Oil Production in Brunei", Society of Petroleum Engineers, SPE 72130, Oct. 8-9, 2001.

Wilson et al., "Driving CompletionTechnology in Subsea, Multilateral Well with Sand Control and Downhole Flow Control", Society of Petroleum Engineers, SPE 107814, May 30-Jun. 1, 2007.

Yildiz, "Productivity of Horzontal Wells Completed with Screens", Society of Petroleum Engineers, SPE 76712, May 20-22, 2002.

* cited by examiner

METHODS OF PRODUCING HYDROCARBONS FROM UNCONSOLIDATED SAND FORMATIONS

TECHNICAL FIELD

The present disclosure relates to natural resource well drilling and hydrocarbon production and, more specifically, to methods of producing hydrocarbons.

BACKGROUND

The discovery and extraction of hydrocarbons, such as oil or natural gas, from subsurface formations, may be impeded for a variety of reasons, such as inherently poor permeability or damage to the formation. The production rate of hydrocarbons from a hydrocarbon-producing region of the formation may be reduced compared to the expected production rate. These instances may result because of sand production from the subsurface formation. Sand production is the migration of formation sand from the subsurface formation 200 caused by the flow of reservoir fluids. The production of sand is generally undesirable since it can restrict productivity, erode completion components, impede wellbore access, interfere with the operation of downhole equipment, and present significant disposal difficulties.

SUMMARY

A continuing need exists for methods of producing hydrocarbons without sand production. To reduce sand production it may be desirable to drill a secondary wellbore away from an original wellbore. The present disclosure is directed to methods for drilling an uncompleted lateral wellbore in a subsurface formation including unconsolidated sand that overlays a water-saturated reservoir.

In accordance with one or more embodiments of the present disclosure, a method of drilling an uncompleted lateral wellbore in a subsurface formation includes drilling the uncompleted lateral wellbore with coiled tubing, wherein: the subsurface formation comprises unconsolidated sand; and the subsurface formation overlays a water-saturated reservoir.

In accordance with other embodiments of the present disclosure, a method of producing hydrocarbons from a subsurface formation includes: drilling an uncompleted lateral wellbore with coiled tubing at balanced pressure, wherein: the subsurface formation comprises unconsolidated sand, the subsurface formation comprises hydrocarbons, and the subsurface formation overlays a water-saturated reservoir; introducing particles having an average particle size of from 8 mesh to 140 mesh into the uncompleted lateral wellbore, thereby supporting the uncompleted lateral wellbore and avoiding wellbore collapse; installing a screen in a vertical wellbore fluidly connected to the uncompleted lateral wellbore, wherein the screen has a mesh size of from 325 mesh to 1000 mesh; and producing hydrocarbons from the subsurface formation.

Additional features and advantages of the described embodiments will be set forth in the detailed description which follows. The additional features and advantages of the described embodiments will be, in part, readily apparent to those skilled in the art from that description or recognized by practicing the described embodiments, including the detailed description which follows as well as the drawings and the claims.

BRIEF DESCRIPTION OF THE DRAWINGS

The following detailed description of specific embodiments of the present disclosure can be best understood when read in conjunction with the following drawings, where like structure is indicated with like reference numerals and in which.

DETAILED DESCRIPTION

Figure 1:
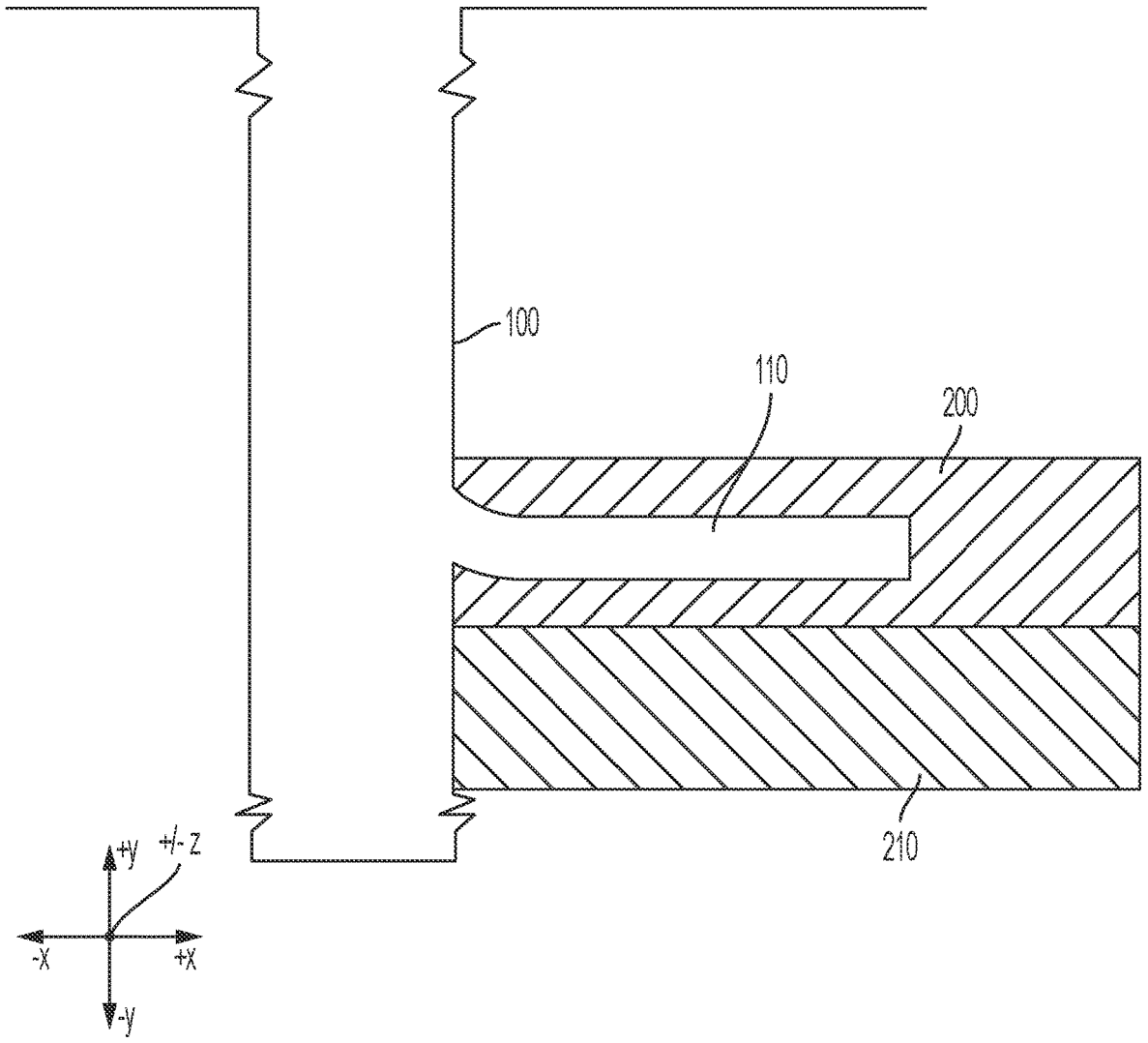
FIG. 1 schematically depicts an uncompleted lateral wellbore in a subsurface formation, according to one or more embodiments described in this disclosure.

As used throughout the disclosure, "aqueous" refers to a fluid containing, producing, resembling, or having the properties of water.

As used throughout the disclosure, "casing" refers to a large-diameter pipe lowered into an openhole and cemented in place. Casing is designed to withstand a variety of forces, such as collapse, burst, and tensile failure, as well as chemically aggressive brines. Most casing joints are fabricated with male threads on each end, and short-length casing couplings with female threads are used to join the individual joints of casing together, or joints of casing may be fabricated with male threads on one end and female threads on the other. Casing may be run to protect freshwater formations, isolate a zone of lost returns, or isolate formations with significantly different pressure gradients. The operation during which the casing is put into the wellbore is commonly called "running pipe." Casing is conventionally manufactured from plain carbon steel that is heat-treated to varying strengths but may be specially fabricated of stainless steel, aluminum, titanium, fiberglass, and other materials.

A formation is the fundamental unit of lithostratigraphy. As used in the present disclosure, the term "formation" refers to a body of rock that is sufficiently distinctive and continuous from the surrounding rock bodies that the body of rock can be mapped as a distinct entity. A formation is, therefore, sufficiently homogenous to form a single identifiable unit containing similar rheological properties throughout the formation, including, but not limited to, porosity and permeability. A single formation may include different regions, where some regions include hydrocarbons and others do not. To produce hydrocarbons from the hydrocarbon regions of the formation, production wells are drilled to a depth that enables these hydrocarbons to travel from the subsurface formation to the surface. This initial stage of production is referred to as "primary recovery."

As used throughout this disclosure, the term "producing subsurface formation" refers to the subsurface formation from which hydrocarbons are produced.

As used throughout this disclosure, the term "proppants" refers to particles mixed with hydraulic fracturing fluid to hold fractures open after a hydraulic fracturing treatment. Proppant materials are carefully sorted for mesh size, roundness and sphericity to provide an efficient conduit for fluid production from the reservoir to the wellbore.

As used throughout this disclosure, the term "reservoir" refers to a subsurface formation having sufficient porosity and permeability to store and transmit fluids.

As used throughout this disclosure, the term "sidetrack" refers to a secondary wellbore away from an original wellbore. The uncompleted lateral wellbore described in this disclosure may be described interchangeably as a sidetrack, a secondary wellbore, or a lateral. Although the present disclosure primarily describes "a" uncompleted lateral wellbore, it should be understood that there is at least one uncompleted lateral wellbore and that there may be two, three, four, five, six, seven, or ten uncompleted lateral wellbores connected to an original wellbore. Therefore, it should be understood that the drilling operations and wellbores described herein may be multilaterals, where there is an original wellbore that has more than one secondary wellbore radiating from the original wellbore.

As used throughout this disclosure, the term "subsurface formation" refers to a body of rock that is sufficiently distinctive and continuous from the surrounding rock bodies that the body of rock may be mapped as a distinct entity. A subsurface formation is, therefore, sufficiently homogenous to form a single identifiable unit containing similar rheological properties throughout the subsurface formation, including, but not limited to, porosity and permeability. A subsurface formation is the fundamental unit of lithostratigraphy.

As used throughout this disclosure, the term "uncompleted wellbore" refers to a wellbore that has not been completed, such as an open hole wellbore. An uncompleted wellbore is a wellbore that has no casing or liner set across the subsurface formation, allowing the produced fluids to flow directly into the wellbore. This type of completion conventionally has the disadvantage that the sandface (the open hole wellbore) is unsupported and may collapse. Also, without any casing or liner installed, selective treatments or remedial work within the reservoir section are more difficult.

As used throughout this disclosure, the term "water cut" refers to the ratio of water produced compared to the volume of total liquids produced.

As used throughout this disclosure, the term "wellbore" refers to the drilled hole or borehole, including the open-hole or uncased portion of the well. Borehole may refer to the inside diameter of the wellbore wall, the rock face that bounds the drilled hole.

In primary recovery, natural formation energy, such as gasdrive, waterdrive, or gravity drainage, displaces hydrocarbons from the formation into the wellbore and up to the surface. Initially, the formation pressure may be considerably greater than the downhole pressure inside the wellbore. This differential pressure may drive hydrocarbons toward the wellbore and up to surface. However, as the formation pressure decreases because of hydrocarbon production, the differential pressure also decreases. To reduce the downhole pressure, or to increase the differential pressure to increase hydrocarbon production, an artificial lift system may be implemented, such as a rod pump, an electrical submersible pump, or a gas-lift installation. Production using artificial lift is considered primary recovery. The primary recovery stage reaches its limit when the formation pressure is reduced to the point that the hydrocarbon production rates are no longer economical or when the proportions of gas or water in the production stream increase to the point that further primary recovery is no longer economical. During primary recovery, only a minority percentage of the initial hydrocarbons in the formation are extracted (typically around 10 percent (%) by volume for hydrocarbon formations).

The present disclosure is directed to methods for drilling uncompleted lateral wellbores in a subsurface formation and to methods for producing hydrocarbons from the uncompleted lateral wellbores. The methods may include drilling an uncompleted lateral wellbore with coiled tubing in the subsurface formation, where the subsurface formation includes unconsolidated sand and the subsurface formation overlays a water-saturated reservoir.

Referring now to FIG. 1, an example installation for producing hydrocarbons from a thin sand reservoir comprising hydrocarbons, where the thin sand reservoir overlays a water-saturated reservoir is illustrated. As shown in FIG. 1, the installation may include a vertical well 100 and an uncompleted lateral wellbore 110 which may be in fluid communication with a subsurface formation 200. As shown in FIG. 1, the subsurface formation 200 overlays a water-saturated reservoir 210.

Although the Figures in the present disclosure depict a vertical wellbore 100 fluidly connected to an uncompleted lateral wellbore 110, it should be understood that the methods described in the present disclosure may apply to any instance in which an uncompleted lateral wellbore 110 may be used to produce hydrocarbons from a sand reservoir that overlays a water-saturated reservoir. For example, and not by way of limitation, the uncompleted lateral wellbore 110 may not be connected to a vertical wellbore 100 but could be a directional wellbore drilled vertically at the surface and then curved into a lateral wellbore to form the uncompleted lateral wellbore 110. Alternatively, when the uncompleted lateral wellbore 110 is fluidly connected to the vertical wellbore 100, as shown, the vertical wellbore 100 may have previously been used to produce hydrocarbons from the subsurface formation 200 or any other subsurface formation along the vertical orientation (the +/−y direction) of the vertical wellbore 100, or, in embodiments, the vertical wellbore 100 may not have been used to produce hydrocarbons previously. Additionally, when the uncompleted lateral wellbore 110 is fluidly connected to the vertical wellbore 100, as shown, the vertical wellbore 100 may or may not be completed. That is, the vertical wellbore 100 may be a completed wellbore or may be an uncompleted wellbore. The vertical wellbore 100 may be completed by a casing.

As described previously in this disclosure, primary recovery relies on natural formation energy to displace hydrocarbons from the subsurface formation 200 into the vertical wellbore 100 and up to the surface. In embodiments, producing hydrocarbons from the subsurface formation 200 through the vertical wellbore 100 without an uncompleted lateral wellbore 110 may result in sand production. Sand production is the migration of formation sand from the subsurface formation 200 caused by the flow of reservoir fluids. The production of sand is generally undesirable since it can restrict productivity, erode completion components, impede wellbore access, interfere with the operation of downhole equipment, and present significant disposal difficulties. To reduce sand production it may be desirable to drill a secondary wellbore away from an original wellbore. For example, it may be desirable to drill an uncompleted lateral wellbore 110 away from a vertical wellbore 100, as shown in FIG. 1. The uncompleted lateral wellbore 110 might bypass an unusable section of the original vertical wellbore 100 or explore a geologic feature nearby, such as the subsurface formation 200. Additionally, drilling the uncompleted lateral wellbore 110 is more desirable than performing a hydraulic fracturing operation on the subsurface formation 200 at least because there is a risk of a fracture extending into the water-saturated reservoir 210, which would result in undesirable water production or water cut.

In some embodiments, the method may include introducing particles 112 into the uncompleted lateral wellbore 110.

Introducing the particles 112 into the uncompleted lateral wellbore 110 may support the uncompleted lateral wellbore 110 and avoid wellbore collapse. In embodiments, introducing the particles 112 may include introducing a composition comprising an aqueous carrier fluid and the particles 112. The aqueous carrier fluid may include one or more than one of fresh water, salt water, brine, municipal water, formation water, produced water, well water, filtered water, distilled water, sea water, other types of water, or combinations of waters. In some embodiments, the aqueous carrier fluid may include water or a solution containing water and one or more inorganic compounds dissolved in the water or otherwise completely miscible with the water. In some embodiments, the aqueous composition may contain brine, including natural and synthetic brine. Brine includes water and a salt that may include calcium chloride, calcium bromide, sodium chloride, sodium bromide, other salts, and combinations of these.

The particles 112 may include gravel, proppants, or combinations thereof. The gravel may be loose rounded fragments of rock. The proppants may include particles of materials such as oxides, silicates, sand, ceramic, resin, epoxy, plastic, mineral, glass, or combinations of these. The proppant particle may include graded sand, treated sand, ceramic, glass, plastic, any combination of these, and any of these materials coated with resin. The proppant particle may include particles of bauxite, sintered bauxite, $Ti^{4+}$/polymer composites, where the superscript "4+" stands for the oxidation state of titanium, titanium nitride (TiN), or titanium carbide. The proppant particle may include glass particles or glass beads. Embodiments of the present disclosure may utilize at least one proppant particle and in embodiments in which more than one proppant particle is used, the proppant particles may contain a combination of different materials. The material of the proppant particle may be chosen based on the particular application and characteristics desired, such as the depth of the subsurface formation in which the proppant particles will be used, as proppant particles with a greater mechanical strength are needed at greater lithostatic pressures.

The particles 112 may include various sizes or shapes. In some embodiments, the particles 112 may have sizes from 8 mesh to 140 mesh (diameters from 106 micrometers (μm) to 2.38 millimeters (mm)). In some embodiments, the particles 112 may have sizes from 8 mesh to 16 mesh (diam. 2380 μm to 1180 μm), 16 mesh to 30 mesh (diam. 600 μm to 1180 μm), 20 mesh to 40 mesh (diam. 420 μm to 840 μm), 30 mesh to 50 mesh (diam. 300 μm to 600 μm), 40 mesh to 70 mesh (diam. 212 μm to 420 μm) or 70 mesh to 140 mesh (diam. 106 μm to 212 μm). The sphericity and roundness of the particles 112 may also vary based on the desired application.

The method may further include drilling the uncompleted lateral wellbore with the coiled tubing at balanced pressure. Coiled tubing is a long, continuous length of pipe wound on a spool. The pipe is straightened prior to pushing into a wellbore and rewound to coil the pipe back onto the transport and storage spool. Coiled tubing may have a pipe diameter of from 1.0 to 3.5 in. and wall thickness of 0.056 in. to 0.204 in. Depending on the pipe diameter and the spool size, the length of coiled tubing can range up to 18,000 ft. [5,486 meters (m)].

In embodiments, drilling the uncompleted lateral wellbore with the coiled tubing is rigless. Specifically, coiled tubing provides the ability to work safely under live well conditions, with a continuous string, enables fluids to be pumped at any time regardless of the position or direction of travel. Installing an electrical conductor or hydraulic conduit further enhances the capability of a coiled tubing string and enables relatively complex intervention techniques to be applied safely. Coiled tubing may be more desirable than conventional straight tubing because conventional tubing must be screwed together, and coiled tubing does not require a workover rig, whereas conventional straight tubing does require a workover rig to maintain overbalance pressure. Specifically, in conventional drilling with straight tubing, a workover rig is required to drill the wellbore because the overbalance pressure must be exerted on the subsurface formation for the drilling operations to function. As used throughout this disclosure, "overbalance pressure" is the amount of pressure (or force per unit area) in the wellbore that exceeds the pressure of fluids in the formation. This excess pressure is needed to prevent reservoir fluids (oil, gas, water) from entering the wellbore. However, excessive overbalance can dramatically slow the drilling process by effectively strengthening the near-wellbore rock and limiting removal of drilled cuttings under the bit. In addition, high overbalance pressures coupled with poor mud properties can cause differential sticking problems. Therefore, it is desirable to drill the uncompleted lateral wellbore with coiled tubing, where the drilling process may be rigless.

Drilling with coiled tubing provides the ability to work with surface pressure while continuously pumping when tripping into and out of the hole. This unique ability allows for maintaining underbalanced conditions on the formation to minimize the potential for formation damage and increase drilling penetration rate. Maintaining underbalanced conditions on the reservoir at all times is critical in reducing the potential for formation damage in sensitive reservoirs. For reservoir pressures that are below hydrostatic pressure, treated water or foamed fluid may be used to keep the bottom hole pressure "at balanced conditions" which is extending coiled tubing drilling to the formation at balanced conditions.

Figure 2:
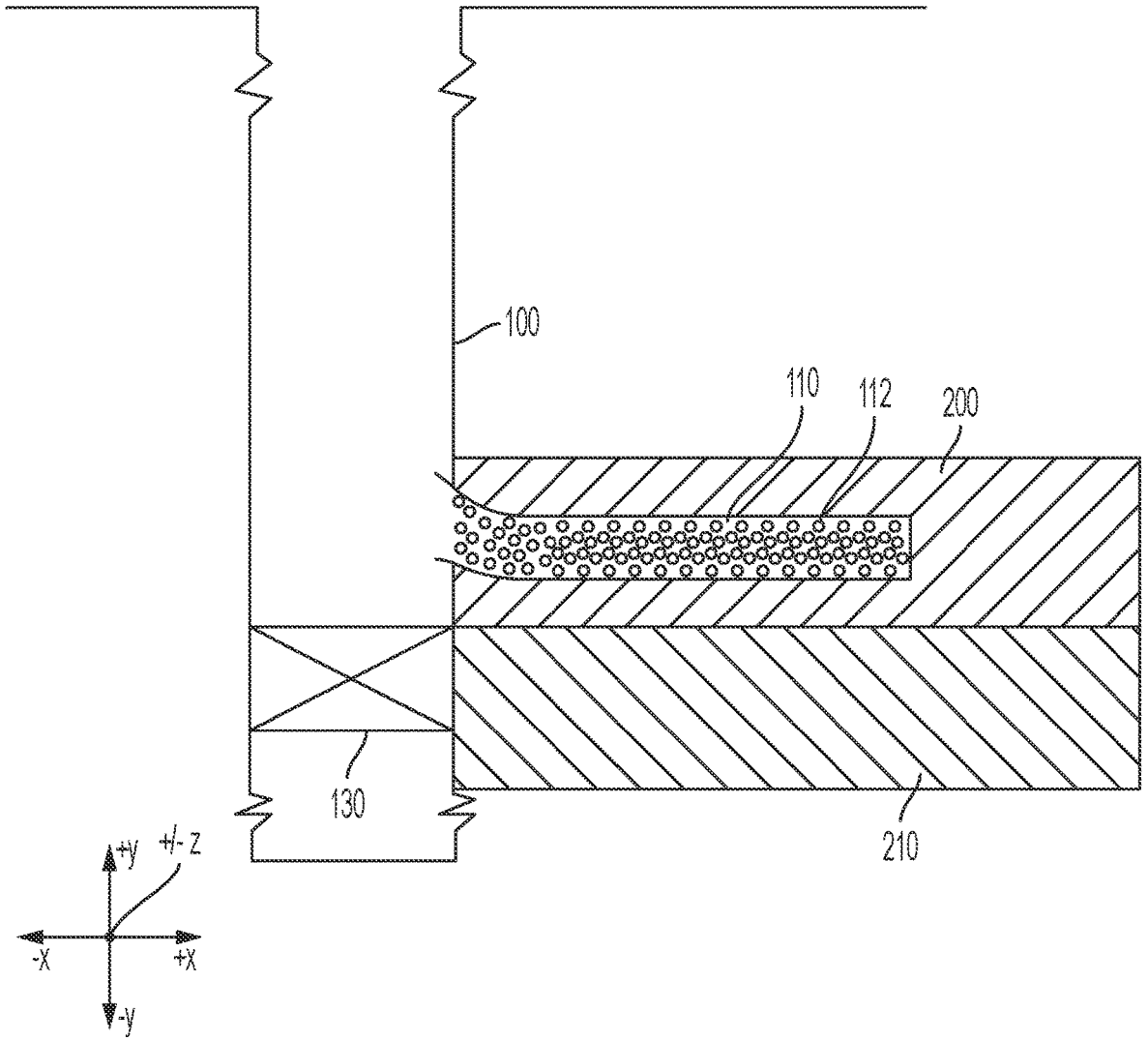
FIG. 2 schematically depicts an uncompleted lateral wellbore in a subsurface formation, according to one or more embodiments described in this disclosure.
Figure 3:
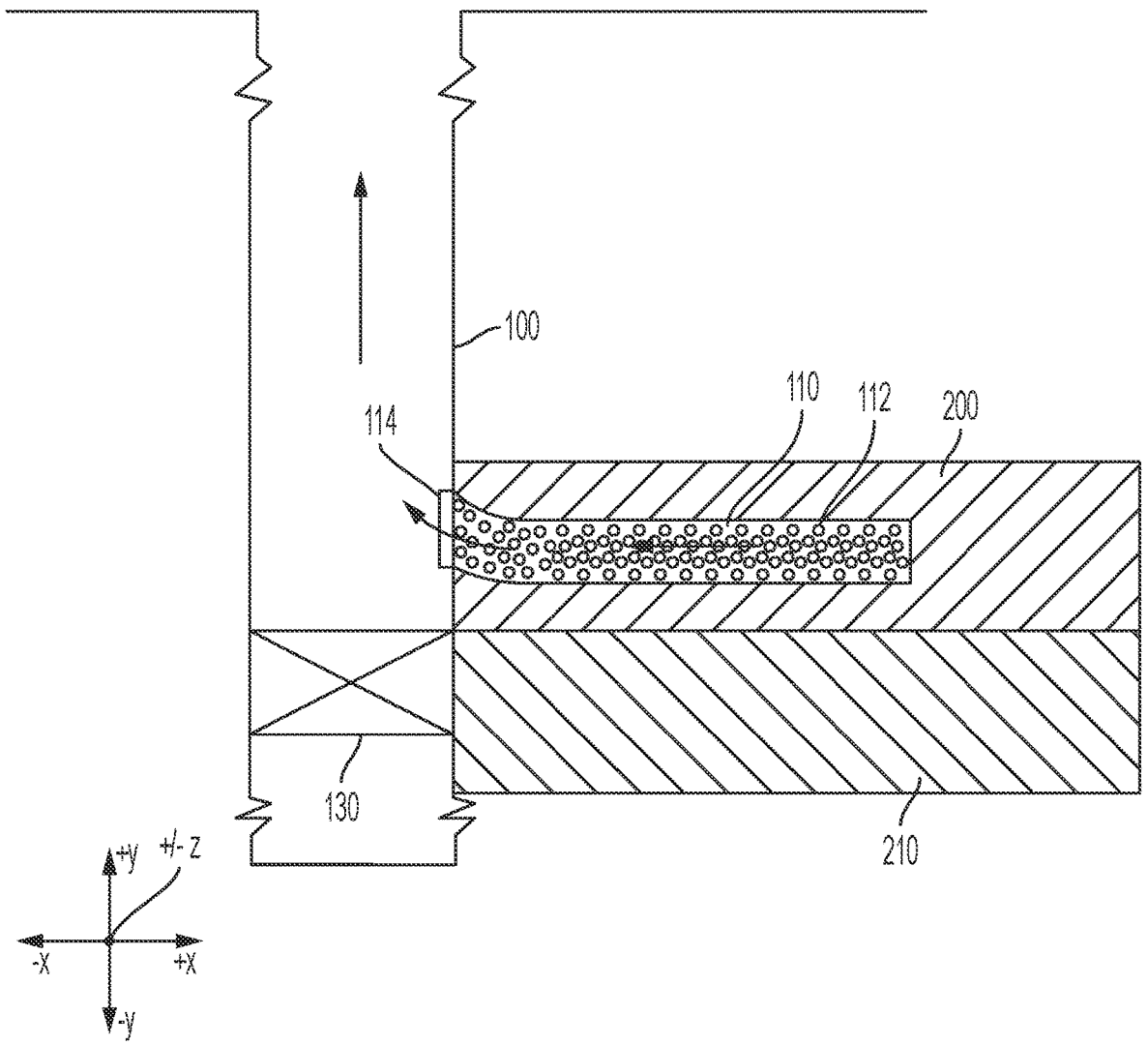
FIG. 3 schematically depicts an uncompleted lateral wellbore in a subsurface formation, according to one or more embodiments described in this disclosure.

The method may further include setting a plug 130 in a vertical wellbore 100 below the subsurface formation 200, as shown in FIGS. 2 and 3. The plug 130 may be cement and may be set in open hole or in casing. The plug 130 may be set to prevent fluid communication between an abandoned lower portion of the vertical wellbore 100 and the upper part of the vertical wellbore 100. In embodiments, a plug 130 may also be set to provide a seat for directional drilling tools used for drilling the uncompleted lateral wellbore 110.

The method may further include installing a screen 114 in a vertical wellbore 100 fluidly connected to the uncompleted lateral wellbore 110, as shown in FIG. 3. In embodiments where the vertical wellbore 100 is completed, installing the screen 114 in the vertical wellbore 100 may include installing the screen 114 at a casing opening between the vertical wellbore 100 and the uncompleted lateral wellbore 110. In embodiments where the vertical wellbore 100 is completed, installing the screen 114 in the vertical wellbore 100 may include installing the screen 114 at a connection point between the vertical wellbore 100 and the uncompleted lateral wellbore 110, where the connection point is the beginning of the open hole of the uncompleted lateral wellbore 110 along the side of the vertical wellbore 100.

The screen 114 may be a sand screen, which is a device used in sand control applications to support the particles 112. In embodiments, the screen 114 may include a through-tubing sand screen. When the screen 114 is a through-tubing sand screen, the screen 114 may be installed through a tubing string. To form the sand screen, a profiled wire may be wrapped and welded in place on a perforated liner. The space between each wire wrap must be small enough to retain the particles 112 placed behind the screen, yet minimize any restriction to production. The screen 114 may have a mesh size of from 125 to 1000 mesh, from 125 to 750 mesh, from 125 to 500 mesh, from 125 to 300 mesh, from 300 to 1000 mesh, from 300 to 750 mesh, from 300 to 500 mesh, from 500 to 1000 mesh, from 500 to 750 mesh, or from 750 to 1000 mesh.

In some embodiments, the subsurface formation 200 may have a vertical dimension of from 10 to 1000 feet, from 10 to 750 feet, from 10 to 500 feet, from 10 to 250 feet, from 10 to 100 feet, from 10 to 50 feet, from 50 to 1000 feet, from 50 to 750 feet, from 50 to 500 feet, from 50 to 250 feet, from 50 to 100 feet, from 100 to 1000 feet, from 100 to 750 feet, from 100 to 500 feet, from 100 to 250 feet, from 250 to 1000 feet, from 250 to 750 feet, from 250 to 500 feet, from 500 to 1000 feet, from 500 to 750 feet, or from 750 to 1000 feet. The vertical dimension is the +/−y direction as illustrated in FIGS. 1-3. In embodiments, the subsurface formation 200 may be a thin formation. The subsurface formation 200 may include hydrocarbons. The method may further include producing hydrocarbons from the subsurface formation 200 as indicated by the arrows in FIG. 3. In embodiments, the method may include producing a first rate of production of hydrocarbons from the subsurface formation 200 through the vertical wellbore 100 before drilling the uncompleted lateral wellbore 110. The method may then include increasing hydrocarbon production from the subsurface formation 200 by producing a second rate of production of hydrocarbons from the subsurface formation 200 through the uncompleted lateral wellbore 110, in which the second rate of production of hydrocarbons is greater than the first rate of production of hydrocarbons.

It is noted that one or more of the following claims utilize the term "where" or "in which" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising." For the purposes of defining the present technology, the transitional phrase "consisting of" may be introduced in the claims as a closed preamble term limiting the scope of the claims to the recited components or steps and any naturally occurring impurities. For the purposes of defining the present technology, the transitional phrase "consisting essentially of" may be introduced in the claims to limit the scope of one or more claims to the recited elements, components, materials, or method steps as well as any non-recited elements, components, materials, or method steps that do not materially affect the novel characteristics of the claimed subject matter. The transitional phrases "consisting of" and "consisting essentially of" may be interpreted to be subsets of the open-ended transitional phrases, such as "comprising" and "including," such that any use of an open ended phrase to introduce a recitation of a series of elements, components, materials, or steps should be interpreted to also disclose recitation of the series of elements, components, materials, or steps using the closed terms "consisting of" and "consisting essentially of." For example, the recitation of a composition "comprising" components A, B, and C should be interpreted as also disclosing a composition "consisting of" components A, B, and C as well as a composition "consisting essentially of" components A, B, and C. Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced.

It should be understood that any two quantitative values assigned to a property may constitute a range of that property, and all combinations of ranges formed from all stated quantitative values of a given property are contemplated in this disclosure. The subject matter of the present disclosure has been described in detail and by reference to specific embodiments. It should be understood that any detailed description of a component or feature of an embodiment does not necessarily imply that the component or feature is essential to the particular embodiment or to any other embodiment.

It should be apparent to those skilled in the art that various modifications and variations may be made to the embodiments described within without departing from the spirit and scope of the claimed subject matter. Thus, it is intended that the specification cover the modifications and variations of the various embodiments described within provided such modifications and variations come within the scope of the appended claims and their equivalents. Unless otherwise stated within the application, all tests, properties, and experiments are conducted at room temperature and atmospheric pressure.

Having described the subject matter of the present disclosure in detail and by reference to specific embodiments of any of these, it is noted that the various details disclosed within should not be taken to imply that these details relate to elements that are essential components of the various embodiments described within, even in cases where a particular element is illustrated in each of the drawings that accompany the present description. Further, it should be apparent that modifications and variations are possible without departing from the scope of the present disclosure, including, but not limited to, embodiments defined in the appended claims. More specifically, although some aspects of the present disclosure are identified as particularly advantageous, it is contemplated that the present disclosure is not necessarily limited to these aspects.

What is claimed is:

1. A method of drilling an uncompleted lateral wellbore in a subsurface formation comprising:

drilling the uncompleted lateral wellbore with coiled tubing in the subsurface formation; and installing a screen in a vertical wellbore fluidly connected to the uncompleted lateral wellbore, wherein:

the subsurface formation comprises unconsolidated sand;

the subsurface formation overlays a water-saturated reservoir; and installing the screen in the vertical wellbore comprises installing the screen at a casing opening between the vertical wellbore and the uncompleted lateral wellbore, the uncompleted lateral wellbore being without any casing or liner installed.

2. The method of claim 1, further comprising introducing particles into the uncompleted lateral wellbore, thereby supporting the uncompleted lateral wellbore and avoiding wellbore collapse.

3. The method of claim 2, wherein introducing particles comprises introducing a composition comprising an aqueous carrier fluid and the particles.

4. The method of claim 2, wherein the particles comprise gravel, proppants, or combinations thereof.

5. The method of claim 2, wherein the particles have an average particle size of from 8 mesh to 140 mesh.

6. The method of claim 1, wherein drilling the uncompleted lateral wellbore with the coiled tubing comprises drilling at balanced pressure.

7. The method of claim 1, wherein drilling the uncompleted lateral wellbore with the coiled tubing is rigless.

8. The method of claim 1, wherein the screen has a mesh size of from 125 mesh to 1000 mesh.

9. The method of claim 1, wherein the screen comprises a through-tubing sand screen.

10. The method of claim 1, wherein the subsurface formation has a vertical dimension from 10 to 250 feet.

11. The method of claim 1, wherein the subsurface formation comprises hydrocarbons.

12. The method of claim 1, further comprising producing hydrocarbons from the subsurface formation.

13. A method of producing hydrocarbons from a subsurface formation comprising:

drilling an uncompleted lateral wellbore with coiled tubing at balanced pressure, wherein:

the subsurface formation comprises unconsolidated sand, the subsurface formation comprises hydrocarbons, and the subsurface formation overlays a water-saturated reservoir;

introducing particles having an average particle size of from 8 mesh to 140 mesh into the uncompleted lateral wellbore, thereby supporting the uncompleted lateral wellbore and avoiding wellbore collapse;

installing a screen in a vertical wellbore fluidly connected to the uncompleted lateral wellbore, wherein the screen has a mesh size of from 325 mesh to 1000 mesh; and producing hydrocarbons from the subsurface formation, wherein installing the screen in the vertical wellbore comprises installing the screen at a casing opening between the vertical wellbore and the uncompleted lateral wellbore, the uncompleted lateral wellbore being without any casing or liner installed.

14. The method of claim 13, wherein the screen comprises a through-tubing sand screen.

15. The method of claim 13, wherein the subsurface formation has a vertical dimension from 10 to 250 feet.

16. The method of claim 13, wherein introducing particles comprises introducing a composition comprising an aqueous carrier fluid and the particles.

17. The method of claim 13, wherein the particles comprise gravel, proppants, or combinations thereof.

18. The method of claim 13, wherein drilling the uncompleted lateral wellbore with the coiled tubing is rigless.

* * * * *